United States Patent [19]

Tannenbaum

[11] Patent Number: 5,069,354

[45] Date of Patent: Dec. 3, 1991

[54] OPENABLE/CLOSEABLE CONTAINER INCLUDING A FRAME FOR SUPPORTING A PAIR OF TRAY MEMBERS

[75] Inventor: Michael A. Tannenbaum, Freehold, N.J.

[73] Assignee: Delvo Industries, Inc., Ivyland, Pa.

[21] Appl. No.: 511,485

[22] Filed: Apr. 19, 1990

[51] Int. Cl.[5] ..... B65D 6/00

[52] U.S. Cl. ..... 220/4.22; 220/4.24; 220/4.33; 220/259; 220/334; 190/122

[58] Field of Search ..... 220/4.03, 4.22, 4.23, 220/4.24, 4.28, 4.33, 334, 337, 339, 256, 259; 190/122, 123, 107, 21

[56] References Cited

U.S. PATENT DOCUMENTS

| | | | |
|---|---|---|---|
| 239,225 | 3/1881 | Claussen | 220/4.24 |
| 2,042,941 | 6/1936 | Hiering . | |
| 2,078,995 | 5/1937 | Bates . | |
| 2,458,233 | 1/1949 | Wemyss . | |
| 2,620,084 | 12/1952 | Prew . | |
| 2,709,534 | 5/1955 | Johnson et al. | 220/4.24 |
| 2,714,469 | 8/1955 | Carlson . | |
| 3,426,889 | 2/1969 | Fuller | 220/256 X |
| 3,513,951 | 5/1970 | Leong et al. | 190/122 X |
| 3,552,595 | 1/1971 | Gerner | 220/339 X |
| 3,710,901 | 1/1973 | Guard et al. | 190/107 |
| 3,786,982 | 1/1974 | Rakes et al. | 220/339 X |
| 3,904,074 | 9/1975 | Hoffman et al. . | |
| 4,139,115 | 2/1979 | Robinson . | |
| 4,205,762 | 6/1980 | Wolfseder | 220/334 |
| 4,293,079 | 10/1981 | Lytle . | |
| 4,563,381 | 1/1986 | Woodland . | |
| 4,618,090 | 10/1986 | Cortellucci | 229/120.09 |
| 4,687,129 | 8/1987 | Cugley | 220/339 X |
| 4,770,312 | 9/1988 | O et al. | 220/4.22 |
| 4,792,056 | 12/1988 | Tiernan . | |

*Primary Examiner*—Stephen Marcus
*Assistant Examiner*—Stephen Cronin
*Attorney, Agent, or Firm*—Panitch, Schwarze, Jacobs & Nadel

[57] ABSTRACT

An openable/closeable container including a rigid frame for supporting a pair of relatively flexible tray members. The container includes a first tubular frame member having an inner surface and an outer surface. The first tubular frame member is constructed of a rigid polymeric material and includes a groove in the inner surface extending towards the outer surface for receiving a flange of a first relatively flexible polymeric tray member therein. A second tubular tray member has an inner surface and an outer surface. The second tubular frame member is constructed of a rigid polymeric material and has a generally identical shape as the first tubular frame member. The second tubular frame member includes a groove in the inner surface extending towards the outer surface for receiving a flange of a second relatively flexible tray member therein. The first and second tubular frame members are hingedly joined together along a common edge by a polymeric hinge for allowing the first and second tubular frame members to pivot between a closed position in which the tubular frame members engage each other to provide a generally closed container and an open position in which the tubular frame members do not engage each other and access is provided to the polymeric tray members.

21 Claims, 2 Drawing Sheets

OPENABLE/CLOSEABLE CONTAINER INCLUDING A FRAME FOR SUPPORTING A PAIR OF TRAY MEMBERS

FIELD OF THE INVENTION

The present invention relates to thermoformed polymeric containers and, more particularly, to frames for providing rigidity to thermoformed polymeric containers.

BACKGROUND OF THE INVENTION

Thermoformed polymeric or thermoplastic containers are well known. The present invention relates to thermoplastic containers which are typically used for cold comestible products, such as salads or sandwiches. Such thermoplastic containers typically comprise a pair of generally transparent or opaque polymeric tray members which are hingedly connected along one side by a polymeric hinge. The hinge is constructed of the same material and thickness as the trays for allowing the trays to pivot with respect to each other between an open position and a closed position. The present invention also relates to an inexpensive semi-permanent package which can be reusable or disposable. That is, the semi-permanent package can be used for storing products for display or storage, such as jewelry, candy, etc.

The thermoplastic tray containers described above are problematic in that they lack rigidity or structural integrity, and, therefore, will often collapse or yield to the weight of the comestible product stored there within. It is difficult to achieve adequate rigidity and structural integrity in such containers without resorting to prohibitively expensive thick sections or ribs involving the use of relatively complex molds.

The hinge which allows the trays to pivot is also problematic. Since the hinge is constructed of the same material and thickness as the tray, it fatigues quickly and, therefore, has a limited life expectancy. As a result, such thermoplastic tray containers are normally used in a disposable manner. In addition, molding the hinge directly to both trays involves the use of more complex molds which increases the overall cost of such tray members.

As mentioned previously, the thermoplastic tray containers are pivotable with respect to each other between an open and a closed position; however, the means for locking the trays in the closed position is inadequate. Typically, such trays are locked in the closed position by a friction fit or a pair of cooperating lips, lugs or flanges. While such methods would appear to be adequate, more often than not the known thermoplastic containers unexpectantly pop open resulting in spillage and waste of the comestible product. This problem is usually resolved by wrapping rubber bands, tape or other external securement devices around the container. However, this is not an efficient solution to the problem and only serves to accentuate or highlight the problem.

Consequently, in the thermoplastic container field, there exists a need for a thermoplastic tray container which has a strong hinge connection and which provides additional rigidity over that permissible with current inexpensive disposable thermoplastic tray containers. There further exists a need for a locking or latching function which will secure the containers in the closed position.

The present invention provides a polymeric openable/closeable container having a frame for supporting a pair of tray members. The frame is constructed of a rigid plastic material and is adapted to receive a pair of thermoplastic tray members. The frame is constructed of a relatively rigid material for increasing the life span of the frame and includes a durable hinge member of the same material for allowing the tray members to pivot between an open and closed position. Furthermore, locking means is provided for securing the container in the closed position.

Consequently, the present invention overcomes many of the disadvantages inherent in the above-described thermoplastic tray containers by providing a rigid frame for increasing the containers rigidity and structural integrity. The frame of the present invention allows the thermoplastic tray members to be formed with a simple inexpensive mold, thereby reducing the manufacturing costs of such containers. Therefore, use of the present invention results in considerable savings in money as well as time for manufacturing and development.

SUMMARY OF THE INVENTION

Briefly stated, the present invention comprises an openable/closeable container including a frame for supporting a pair of tray members. A first frame member is provided having an inner surface and an outer surface. The first frame member includes a groove in the inner surface extending towards the outer surface for receiving a flange of a first tray member therein, such that the first frame member supports the first tray member. A second frame member is provided having an inner surface and an outer surface. The second frame member includes a groove in the inner surface extending towards the outer surface for receiving a flange of a second tray member therein, such that the second frame member supports the second tray member. The first and second frame members are hingedly connected together for allowing the first and second frame members to pivot between a closed position in which the frame members engage each other to provide a generally closed container and an open position in which the frame members do not engage each other and access is provided to the tray members.

BRIEF DESCRIPTION OF THE DRAWINGS

The foregoing summary as well as the following detailed description of the preferred embodiment, is better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF PREFERRED EMBODIMENT

Figure 1:
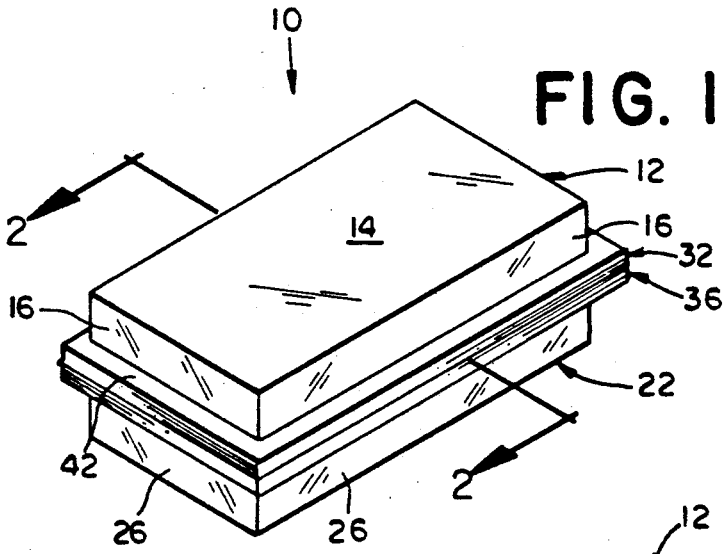
FIG. 1 is a perspective view of an openable/closeable container in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the openable/closeable container and designated parts thereof. The terminology includes the words above specifically mentioned, derivatives thereof and words of similar import.

Figure 2:
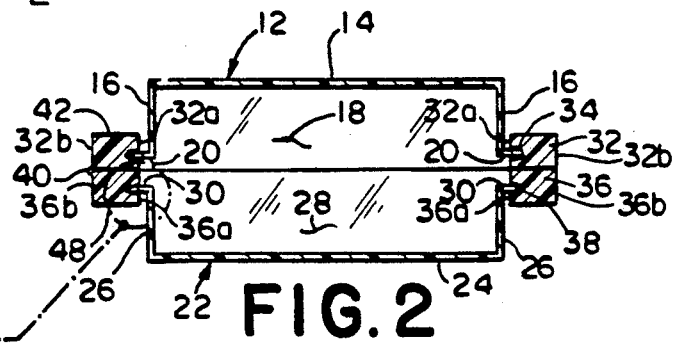
FIG. 2 is an enlarged cross-sectional view of the openable/closeable container of FIG. 1 taken along line 2—2 of FIG. 1.

Referring to the drawings wherein like numerals indicate like elements throughout, there is shown in FIG. 1 a perspective view of an openable/closeable container (hereinafter referred to as "container"), generally designated 10, in accordance with the present invention. The container 10 preferably includes a first polymeric tray member 12. As shown in FIGS. 1 and 2, the first tray member 12 includes a generally planar and generally rectangularly shaped base 14. A set of four corresponding sidewalls 16 extend generally perpendicularly and downwardly from the periphery of the base 14 for defining a receptacle area 18 therebetween.

Figure 2A:
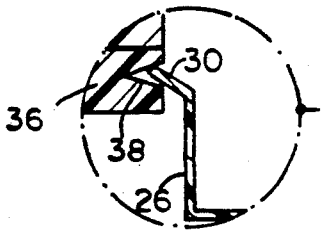
FIG. 2*a* is a greatly enlarged fragmentary view of the frame of the openable/closeable container of FIG. 2.

The sidewalls 16 include a flange 20 at a distal end thereof completely thereabout. As best shown in FIGS. 2*a*, the flange 20 is tapered generally upwardly away from the sidewalls 16 and the base 14 for supporting the first tray member 12. That is, the flange 20 extends from the sidewalls 16 a sufficient distance and angle for allowing a member to grip or engage the flange 20 to support the first tray member 12. However, it is understood by those skilled in the art, that the flange 20 does not have to extend completely about the sidewalls 16, but that the sidewall 16 could include a plurality of flanges (not shown) intermittently spaced thereabout.

As shown in FIGS. 1 and 2, the container 10 includes a second polymeric tray member 22, which is, preferably, generally identical to the first tray member 12. As shown in FIG. 2, the second tray member 22 is invertably positioned with respect to the first tray member 12 and includes a base 24, sidewalls 26, receptacle area 28 and a flange 30, generally as described above.

As shown in FIG. 2, in the present embodiment the first and second tray members 12, 22 are preferably generally "U" shaped in cross section. However, it is understood by those skilled in the art, that the first and second tray members 12, 22 may vary in shape or size or may be of two different shapes and/or sizes. For instance, the second tray member 22 may be deeper or have a larger receptacle area 28 than the first tray member 12. In addition, the first and second tray members 12, 22 may contain divided sections (not shown) for defining plural receptacle areas.

In the present embodiment, the first and second tray members 12, 22 are preferably fabricated of a relatively inexpensive generally transparent polymeric material (e.g. polystyrene) suitable for utilization in a standard thermoform process. More particularly, the first and second tray members 12, 22 are preferably constructed using a thermoform or vacuum-formed process, as is known to those skilled in the art. Preferably the tray members 12, 22 are constructed of a relatively flexible polymeric material as is apparent from the description hereinafter. It is understood by those skilled in the art, that the first and second tray members 12, 22 could be constructed of a generally opaque polymeric material.

Figure 3:
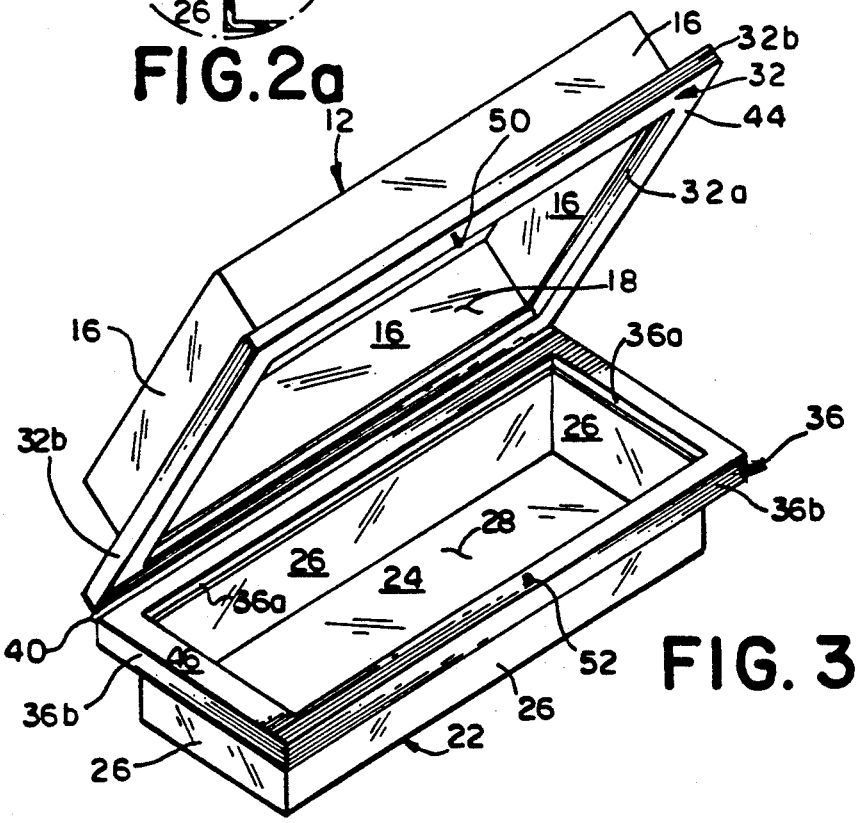
FIG. 3 is an enlarged perspective view of the openable/closeable container of FIG. 1 showing the container in an open position.

Referring now to FIGS. 2 and 3 in the present embodiment, the container 10 preferably includes a first frame member 32 preferably having an inner surface 32*a* and an outer surface 32*b*. As shown in FIG. 2, the first frame member 32 includes a groove or slot 34 in the inner surface 32*a* extending outwardly or towards the outer surface 32*b* for receiving the flange 20 of the first tray member 12 therein, such that the first frame member 32 supports the first tray member 12.

In the present embodiment, it is preferred that the groove 34 be generally "V" shaped in cross-section. However, it is understood by those skilled in the art, that the groove 34 could be of other configurations, such as "U" shaped in cross section. It is further appreciated by those skilled in the art that the groove 34 extends completely around the inner surface 32*a* of the frame member 32. Moreover, it is preferred that the groove 34 extend into the first frame member 32 a distance sufficient to receive a substantial portion of the flange 20 for supporting the first tray member 12 thereon.

In the present embodiment, it is preferred that the first frame member 32 be constructed of a rigid polymeric material, such as propylene. However, it is understood by those skilled in the art, that the first tray member 32 can be constructed of other materials, such as polyethylene or polystyrene. Specifically, in the present embodiment, it is preferred that the first frame member 32 be constructed utilizing an injection mold process, as is apparent to those skilled in the art.

Since the first tray member 32 is preferably constructed of a generally rigid material, it is understood that the first and second tray members 12, 22 are each generally flexible as compared to the first frame member 32.

Referring now to FIGS. 2 and 3, in the present embodiment, the container 10 also includes a second frame member 36 which is preferably generally identical in shape to the first frame member 32, except as otherwise indicated hereinafter. That is, the second frame member 36 includes an inner surface 36*a*, outer surface 36*b* and a groove 38. Moreover, the second frame member is preferably constructed of the same material as the first frame member 32. Consequently, further description of the second frame member 36 is not included for convenience only and, therefore, is not limiting.

Referring now to FIG. 3, in the present embodiment, it is preferred that the first frame member 32 be generally tubular or annular-like and generally rectangularly shaped. The inner surface 32*a* periphery of the first frame member 32 is shaped to be slightly larger than the outer periphery of the side walls 16, to allow the side walls 16 to pass therethrough. The flange 20 is sized to be slightly larger than the inner surface 32*a* periphery of the first frame member 32 for allowing the flange of the first tray member 12 to be snap fit within the groove 34. The second member 22 and second frame member 36 are similarly shaped to cooperate in the same manner.

However, it is understood by those skilled in the art that the present invention is not limited to a groove configuration for securing the tray members 12, 22 to the frame members 32, 36, respectively. For instance, a separate snap-in piece (not shown) could be employed to clamp the flanges 20, 30 to the frame members 32, 36, respectively.

The ordinarily skilled artisan also understands that the first and second frame members 32, 36 can be of any geometric shape so long as they correspond to the geometric shape of the first and second tray members 12, 22, respectively. For instance, the first and second frame members 32, 36 could be generally tubular and square or octagonal shaped.

Figure 4:
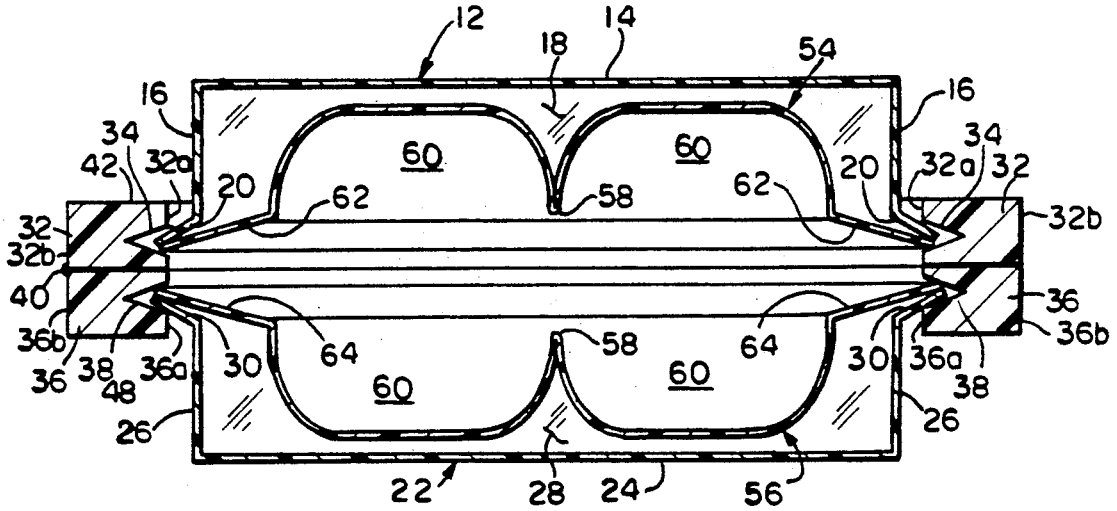
FIG. 4 is an enlarged cross-sectional view of an openable/closeable container in accordance with an alternate embodiment of the invention.

Referring now to FIG. 4, in an alternate embodiment of the invention, a third and fourth tray member 54 and 56 having flanges 62, 64 is inserted within each groove 34, 38, respectively. The third and fourth tray members 54 and 56 preferably include a partition 58 to define a pair of sectioned areas 60. It is further understood by those skilled in the art, that the third and fourth tray members can include any number of partitions for defining a number of sectioned areas.

Referring now to FIGS. 2 and 3, in the present embodiment, it is preferred that the first and second frame members 32, 36 be hingedly connected together for allowing the first and second frame members 32, 36 to pivot between a closed position (as shown in FIG. 1) in which the first and second frame members 32, 36 engage each other in a facing relationship to provide a generally closed container and an open position (as shown in FIG. 3) in which the first and second frame members 32, 36 do not engage each other and access is provided to the receptacle areas 18, 28 of the first and second tray members 12, 22.

In the present embodiment, it is preferred that the first and second frame members 32, 36 be hingedly joined together along a common edge by a hinge 40. Preferably, the hinge 40 is constructed of a polymeric material. More particularly, it is preferred that the first and second frame members 32, 36 and the hinge 40 all be constructed of the same polymeric material. Since the hinge is constructed of a rigid polymeric material, it does not fatigue quickly thereby allowing the frame members 32, 36 to be repeatedly used.

As shown in FIGS. 2 and 3, the first frame member 32 includes top and bottom generally parallel surfaces 42, 44, respectively. Similarly, the second frame member 36 includes top and bottom generally parallel surfaces 46, 48, respectively. As shown at FIG. 2, the bottom surface 44 of the first frame member 32 is in facing engaging relationship with the top surface 46 of the second frame member 36 when the first and second frame members 32, 36 are in the closed position.

In the present embodiment, it is preferred that the first and second frame members 32, 36 include locking means for locking the first and second frame members 32, 36 in the closed position. Preferably, the locking means comprises a male member 50 extending generally perpendicularly from the bottom surface 44 of the first frame member 32 and a female member 52 positioned within the second frame member 36, as shown in FIG. 3. More particularly, it is preferred that the locking means comprise a bulbous peg extending from the first frame member 32 and a aperture or bore extending into the second frame member 36 from the top surface 46 thereof suitably sized to frictionally receive the peg.

However, it is understood by those skilled in the art that other means can be used for lockably securing the first and second frame members 32 and 36 in the closed position. For instance, a pivoting latch member can be secured to the first frame member for engagement with a projection on the second frame member (not shown) or any other standard fastener may be used, as is understood by those skilled in the art. Since the first and second frame members 32, 36 are constructed of a rigid material, hardware type fasteners can be readily adapted thereto for securely locking the container 10 in the closed position.

As shown in FIG. 1, in the present embodiment, it is preferred that the base 14 of the first tray member 12 be positioned on one side of the first and second frame members 32, 36 and the base 24 of the second tray member 22 be positioned on another side of the first and second frame members 32, 36.

In use, the first and second frame members 32 and 36 are preferably stored separately from the first and second tray members 12, 22. The first tray member 12 is inserted into the first frame member 32 by snapping or inserting the flange 20 within the groove 34 in the first frame member 32. Similarly, the second tray member 22 is snapped into or inserted within the groove 38 in the second frame member 36 for securely positioning the first and second tray members 12, 22 on the first and second frame members 32, 36 to thereby form the container 10.

The container 10 is then set in the open position and comestible or any other types of products stored therein. The container is then placed in the closed position and locked. The frame members 32, 36 provide the tray members 12, 22 with structural integrity by allowing the user to handle the entire assembly or container 10 merely by holding the first and second frame members 32, 36 which will not yield to the forces created by the products stored therein, thereby yielding a strong rigid container 10.

After the products are removed from the container 10, the first and second tray members 12, 22 are disposed of and the first and second frame members 32, 36 are ready to be used again. As is apparent from the above description, the container 10 has significant advantages over the prior art containers. The first and second tray members 12, 22 are generally identical and are constructed of an inexpensive material, thereby resulting in a significant savings in the design of the mold and the manufacture thereof. Furthermore, since the first and second frame members 32, 36 are constructed of a rigid material, a strong hinge connection is provided thereby allowing the frame members 32, 36 to be repeatedly used. In addition, the first and second frame members 32, 36 allow the incorporation of a reliable locking or securing function.

While the above description is directed to storing comestible products within the container 10, the present invention is not limited thereto. It is understood by those skilled in the art that other items could be stored or packaged within the container 10, such as plasticware, binder clips, etc., without departing from the spirit and scope of the invention.

From the foregoing description, it can be seen that the present invention comprises an openable/closeable container including a frame for supporting a pair of tray members. It is recognized by those skilled in the art that changes may be made to the above-described embodiments of the invention without departing from the broad inventive concept thereof, it is understood, therefore, that this invention is not limited to the particular embodiments disclosed, but is intended to cover all modifications which are within the spirit and scope of the invention as defined by the appended claims.

I claim:

1. An openable/closeable container comprising:

a first frame member having an inner surface and an outer surface, said first frame member including a groove in said inner surface extending towards said outer surface for releasably receiving a flange of a first tray member therein, such that said first frame member releasably supports said first tray member; and a second frame member having an inner surface and an outer surface, said second frame member including a groove in said inner surface extending towards said outer surface for releasably receiving a flange of a second tray member therein, such that said second frame member releasably supports said second tray member, said first and second frame members being hingedly connected together for allowing the first and second frame members to pivot between a closed position in which the frame members engage each other to provide a generally closed container and an open position in which the frame members do not engage each other and access is provided to the tray members.

2. The container as recited in claim 1, wherein said first and second frame members are constructed of an injection molded rigid polymeric material and said tray members are constructed of a vacuum formed relatively flexible polymeric material.

3. The container as recited in claim 1, wherein said groove in said first and second frame members is generally "V" shaped in cross section.

4. The container as recited in claim 1, wherein said first and second frame members are hingedly joined together along a common edge by a polymeric hinge.

5. The container as recited in claim 1, wherein said first and second frame members are generally identical in shape.

6. The container as recited in claim 1, wherein said first and second frame members are generally tubular.

7. The container as recited in claim 1, wherein said first and second frame members each have top and bottom generally parallel surfaces, said bottom surface of said first frame surface being in facing engaging relationship with said top surface of said second frame member when said first and second frame members are in said closed position.

8. The container as recited in claim 1, wherein said first and second frame members include locking means for locking the first and second frame members in said closed position.

9. The container as recited in claim 1, further including a third tray member having a flange inserted within the groove of one of said first and second frame members, said third tray member being positioned between said first and second tray members, said third tray member including a partition to define a sectioned area.

10. The container as recited in claim 9, wherein said flange of said third tray member is inserted within the groove of said first frame member and further including a fourth tray member having a flange inserted within the groove of said second frame member, said third and fourth tray members being positioned between said first and second tray members, said fourth tray member including a partition to define a sectioned area.

11. An openable/closeable container including a frame for supporting a pair of tray members, said container comprising:

a first and second polymeric tray member each having a base and sidewalls extending therefrom for defining a receptacle area, said sidewalls including a flange extending therefrom for supporting said tray member;

a first frame member having an inner surface and an outer surface, said first frame member including a groove in said inner surface extending towards said outer surface for releasably receiving said flange of said first polymeric tray member therein, said flange of said first polymeric tray member being snap-fitted into said groove such that said first frame member releasably supports said first tray member; and a second frame member having an inner surface and an outer surface, said second frame member including a groove in said inner surface extending towards said outer surface for receiving said flange of said second polymeric tray member therein, said first and second frame members being hingedly connected together for allowing the first and second frame members to pivot between a closed position in which the frame members engage each other to provide a generally closed container and an open position in which the frame members do not engage each other and access is provided to the tray members.

12. The container as recited in claim 11, wherein said first and second frame members are constructed of an injection molded rigid polymeric material and said tray members are constructed of a vacuum formed relatively flexible polymeric material.

13. The container as recited in claim 12, wherein said first and second polymeric tray members are each flexible as compared to said first and second frame members.

14. The container as recited in claim 11, wherein said groove in said first and second frame members is generally "V" shaped in cross section.

15. The container as recited in claim 11, wherein said first and second frame members are hingedly joined together along a common edge by a polymeric hinge.

16. The container as recited in claim 11, wherein said first and second frame members are generally identical in shape.

17. The Container as recited in claim 11, wherein said first and second frame members are generally tubular.

18. The container as recited in claim 11, wherein said first and second frame members each have top and bottom generally parallel surfaces, said bottom surface of said first frame member being in facing engaging relationship with said top surface of said second frame member when said first and second frame members are in said closed position.

19. The container as recited in claim 11, wherein said first and second frame members further include locking means for locking said first and second frame members in said closed position.

20. The container as recited in claim 11, wherein said base of said first polymeric tray member is positioned on one side of said first and second frame members and said base of said second polymeric tray member is positioned on another side of said first and second frame members.

21. The container as recited in claim 11, wherein said flange of said second polymeric tray member is snap-fitted into said groove in said second frame member such that said second frame member releasably supports said second polymeric tray member.

* * * * *